United States Patent [19]

Oshima et al.

[11] Patent Number: 4,571,125

[45] Date of Patent: Feb. 18, 1986

[54] FLOATING OFFSHORE STRUCTURE

[75] Inventors: Masanao Oshima, Tokyo; Hitoshi Narita, Musashino; Nobuyoshi Yashima, Funabashi; Hiroshi Tabuchi, Yokohama, all of Japan

[73] Assignee: Mitsui Engineering and Shipbuilding Company, Limited, Japan

[21] Appl. No.: 712,131

[22] Filed: Mar. 15, 1985

Related U.S. Application Data

[62] Division of Ser. No. 478,327, Mar. 24, 1983.

[30] Foreign Application Priority Data

Apr. 16, 1982 [JP] Japan ..... 57-63628
Apr. 16, 1982 [JP] Japan ..... 57-63629

[51] Int. Cl.[4] ..... E02B 17/00

[52] U.S. Cl. ..... 405/224; 405/195; 405/61; 405/217; 114/264

[58] Field of Search ..... 405/208, 203, 224; 114/264; 175/7

[56] References Cited

U.S. PATENT DOCUMENTS

| | | | |
|---|---|---|---|
| 2,699,321 | 1/1955 | Nelson | 114/264 X |
| 3,279,404 | 10/1966 | Richardson | 114/264 |
| 3,563,041 | 2/1971 | Michel | 405/211 |
| 3,605,415 | 6/1969 | Mohlman . | |
| 3,605,668 | 9/1971 | Morgan | 171/7 X |
| 3,766,874 | 10/1973 | Helm et al. | 114/264 |
| 3,774,562 | 11/1973 | Dean | 114/264 |
| 3,886,882 | 6/1975 | Thornburg et al. . | |
| 4,048,943 | 9/1977 | Gerwick . | |
| 4,102,144 | 7/1978 | Anders . | |
| 4,117,691 | 10/1978 | Spray | 405/205 |
| 4,216,834 | 8/1980 | Wardlaw . | |
| 4,434,741 | 3/1984 | Wright et al. . | |

FOREIGN PATENT DOCUMENTS 915927 12/1972 Canada . .

*Primary Examiner*—Dennis L. Taylor
*Attorney, Agent, or Firm*—Parkhurst & Oliff

[57] ABSTRACT

A floating offshore structure which is moored at a fixed position on the sea by means of mooring hawsers and anchors connected to the ends thereof respectively for conducting a submarine excavating operation from a deck of the structure. The structure includes a moorage hull part provided with a vertical through-hole formed therein for receiving an excavating drill pipe and the mooring hawsers and a movable hull part connected to the moorage hull part so as to be rotatable within a horizontal plane. The movable hull part is constituted as a hull defining the outer wall of the floating offshore structure and connected with the moorage hull part by inserting it into a moorage hull part receiving hole formed at a position closer to the bow thereof. The movable hull part has near its water plane a horizontal section with a substantially oval shape formed by a fore draft part in a substantially circular or polygonal shape with the moorage hull part receiving hole as a center and an after draft part taperingly projecting aft from the fore draft part.

4 Claims, 16 Drawing Figures

FLOATING OFFSHORE STRUCTURE

This is a division of application Ser. No. 478,327, filed Mar. 24, 1983.

BACKGROUND OF THE INVENTION

1. Field of the Invention

The present invention relates to a floating offshore structure and more particularly to a structure floating offshore and moored so as to be positioned at a substantially fixed position, such as a floating deck structure usable for submarine excavation, for example.

2. Description of the Prior Art

With a steep rise in demand for oil, submarine oil fields have been vigorously developed. Also, other submarine resources have been energetically investigated and developed. As a movable excavating apparatus for effecting these developments, for example, a floating offshore structure is employed. The floating offshore structure of this type is a large-sized structure having a diameter or longitudinal or lateral dimension of nearly 100 m, for example, and a displacement of nearly from 30 to 40 thousand tons. Such a structure employes a large number (e.g., 12) of mooring hawsers so as to be moored at a fixed position on the sea by means of anchors connected to the ends of these mooring hawsers respectively.

The floating offshore structure of this type which is employed in an icy sea area in cold waters where floating ice is present conventionally has a planar shape which is a circle or a polygon close to a circle. Therefore, in case of conducting excavation in a frozen sea, this structure is made to have no directional property with respect to the floating ice force (the collision force of floating ice) and, hence, is independent of the flowing direction of the floating ice. On the other hand, however, since the structure has a circular section, the width allowing floating ice to collide is large relatively for a given effective deck area, so that the structure receives a correspondingly large collision force of floating ice. For the same reason, the movement of the structure due to waves is larger.

Moreover, in a floating offshore structure for submarine excavation, such as an oil rig, a vertical through-hole is formed in the structure body, i.e., the hull, and an excavating drill pipe driven by an excavator on the deck is passed through the through-hole and extended to the sea bottom to carry out operations. In the floating offshore structure of this kind, the vertical through-hole has hitherto been formed as a hole opened in the hull bottom. Therefore, in case of using the structure in a frozen sea, such as cold waters where floating ice is present, some of the blocks of ice broken by the outer wall of the hull on the fore side (the side with which floating ice collides) scatter in the sea around the hull bottom and may undesirably enter the vertical through-hole from its opening formed in the hull bottom, resulting in damage to the excavating drill pipe and mooring hawsers extending through the through-hole.

SUMMARY OF THE INVENTION

It is, therefore, an object of the present invention to provide a floating offshore structure absorbing few of the forces of floating ice, waves, tide, and wind received by the structure for a given effective deck area than the conventional floating offshore structures, thereby decreasing the pitch and roll of the structure, as well as being capable of smoothly rotating in response to the change in the flowing direction of floating ice or the like so as to prevent the associated increase in the forces of floating ice, waves, tide and wind, thereby overcoming the above-mentioned problems of the prior art.

To this end, according to the invention, there is provided a floating offshore structure which is moored at a fixed position on the sea by means of mooring hawsers and anchors connected to the ends of the mooring hawsers respectively, for conducting a submarine excavating operation from the deck, comprising: a moorage hull part including a vertical through-hole formed therein for receiving an excavating drill pipe and the mooring hawsers as well as mooring hawser winches installed thereon; and a movable hull part connected to the moorage hull part so as to be rotatable within a horizontal plane, wherein the movable hull part is constituted as a hull defining the outer wall of the floating offshore structure and connected with the moorage hull part by inserting the same into a moorage hull part receiving hole formed at a position closer to the bow thereof, the movable hull part having near its water plane a horizontal section with a substantially oval shape formed by a fore draft part in a substantially circular or polygonal shape, with the moorage hull part receiving hole as a center and an after draft part taperingly projecting aft from the fore draft part.

Moreover, to the above end, according to another aspect of the invention, there is provided a floating offshore structure which is moored at a fixed position on the sea by means of mooring hawsers and anchors connected to the ends of the mooring hawsers respectively, for conducting a submarine excavating operation from the deck, comprising: a moorage hull part including a vertical through-hole formed therein for receiving an excavating drill pipe and the mooring hawsers as well as mooring hawser winches installed thereon; and a movable hull part connected to the moorage hull part so as to be rotatable within a horizontal plane, wherein a hull defining the outer wall of the floating offshore structure is constituted by the moorage hull part in a substantially rotatable body shape with a vertical axis and the movable hull part connected thereto so as to be rotatable about the vertical axis, the hull having near its water plane a horizontal section with a shape formed by a circular fore draft part defined by the moorage hull part and an after draft part defined by the movable hull part and having a width narrower than the fore draft part.

It is another object of the invention to provide a floating offshore structure capable of preventing floating ice from entering the through-hole for receiving the excavating drill pipe.

According to the invention, there is provided a floating offshore structure which is moored at a fixed position on the sea by means of mooring hawsers and anchors connected to the ends of the mooring hawsers respectively for conducting a submarine excavating operation by extending an excavating drill pipe to the sea bottom through a vertical through-hole formed in the hull, wherein a tubular body is provided downwardly projecting from the periphery of the opening of the vertical through-hole formed in the hull bottom as well as having an overhanging part formed around the outer periphery of the lower end thereof. In this case, it is preferable to permit the tubular body to be adjustable between a projecting position and a withdrawing position with respect to the hull so that the resistance in towing can be decreased.

Above and other objects and features of the invention will be apparent from the following description when the same is read in conjunction with the accompanying drawings.

DESCRIPTION OF THE PREFERRED EMBODIMENTS

Preferred embodiments of the invention will be described hereinunder with reference to the accompanying drawings.

FIGS. 1 thru 4 show a floating offshore structure in accordance with a first preferred embodiment of the invention.

Figure 1:
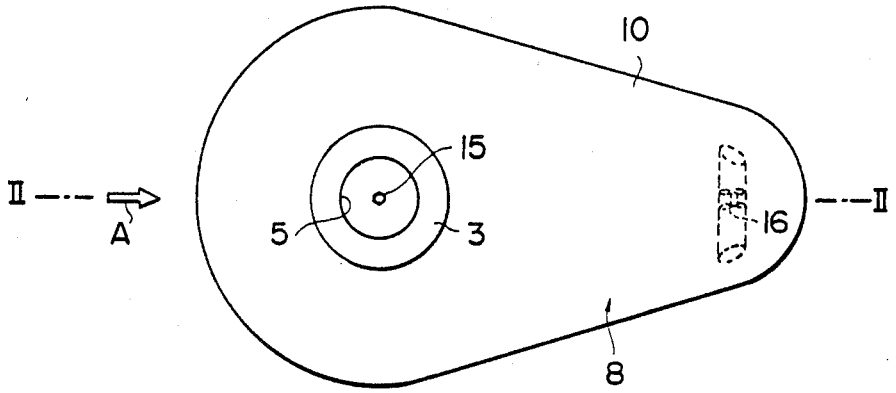
FIG. 1 is a plan view of a floating offshore structure in accordance with a first preferred embodiment of the invention.
Figure 2:
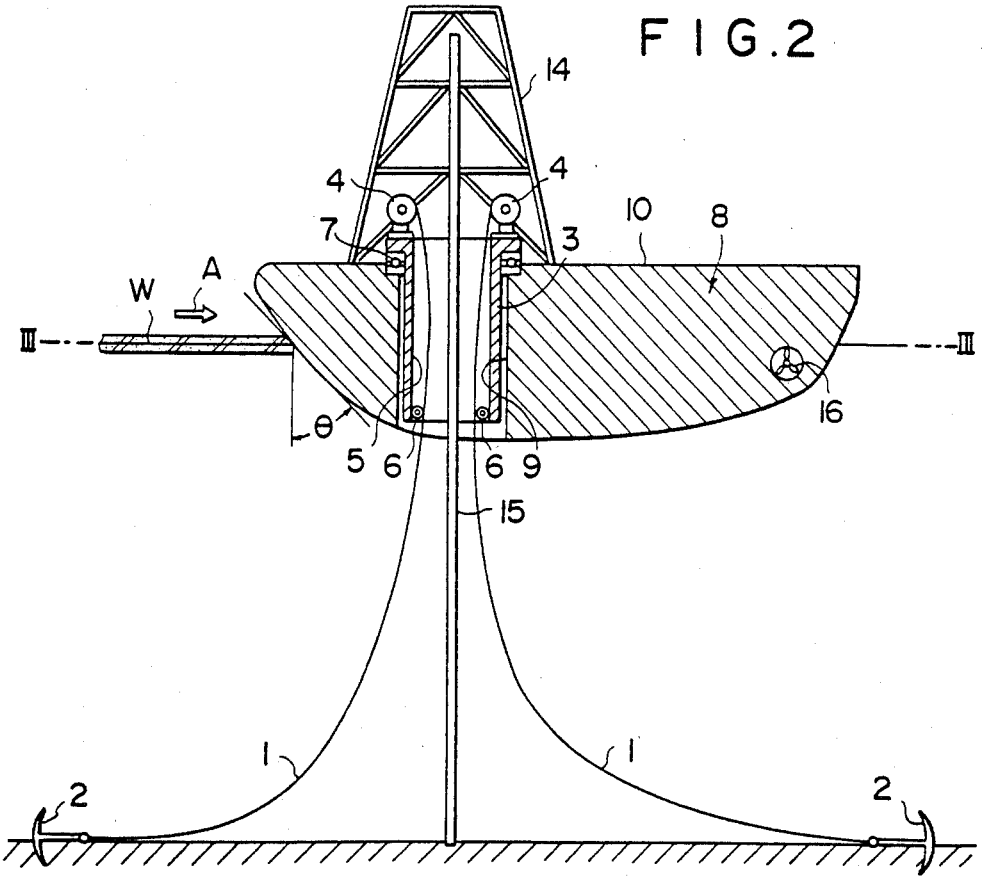
FIG. 2 is a sectional view taken along a line II—II of FIG. 1.
Figure 3:
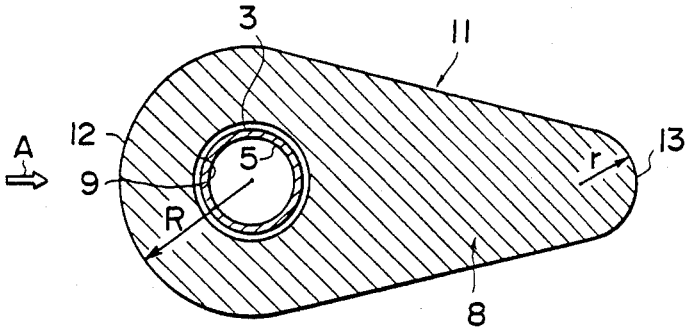
FIG. 3 is a sectional view of the floating offshore structure shown in FIG. 1 taken along a line III—III of FIG. 2, i.e, a water plane thereof.

Referring to FIGS. 1 thru 3, a moorage hull part 3 is moored at a fixed position on the sea by means of a plurality (e.g., twelve) of mooring hawsers 1 radially extending to the sea bottom from their respective positions substantially equally spaced in the circumferential direction, together with anchors 2 connected to the ends of the mooring hawsers 1, respectively. The moorage hull part 3 has a substantially cylindrical shape with an overhanging upper end surface, on which winches 4 for winding and unwinding the respective mooring hawsers 1 are installed. As illustrated, the mooring hawsers 1 are passed through a vertical through-hole 5 formed in the moorage hull part 3, and stretched in the sea, being guided by pulleys 6 disposed near the through-hole lower end, respectively.

A movable hull part 8 is fitted around the moorage hull part 3 through low-frictional means 7 such as bearings so as to be rotatable within a horizontal plane, i.e., about a vertical axis. In the illustrated embodiment, a moorage hull part receiving hole 9 is formed as a vertical through-hole at a position closer to the bow of the movable hull part 8 (closer to the left side as viewed in FIG. 1), and the movable hull part 8 and the moorage hull part 3 are connected together with the latter inserted in the receiving hole 9. In other words, the movable hull part 8 is constituted as a hull defining the outer wall of the floating offshore structure, which is assembled having the moorage hull part 3 received in the receiving hole 9 formed inside the hull.

Thus, as shown in FIGS. 1 and 3, both the planar shape of a deck 10 formed on the upper surface of the movable hull part 8 and a water plane thereof (a section taken along a water surface W) 11 are substantially oval. Particularly, the water plane, i.e., a horizonal section near the water surface, has an oval shape including a fore draft part 12 in the shape of a substantially circular arc (radius R) with the moorage hull part receiving hole 9 as a center and an after draft part 13 taperingly projecting aft from the fore draft part. Although the after draft part 13 has a shape of a circular arc with a radius r smaller than the radius R of the fore draft part 12 in the illustrated embodiment, the shape of the after part can be formed into a rectilinear or any other desired shape. Moreover, although the fore draft part 12 has a shape of a circular arc with a radius R, this shape is not exclusive and may be a polygon.

The outer wall of the movable hull part 8 is inclined downwardly inward, similarly to conventional hulls. Especially, the outer wall near the fore draft part 12 is inclined in order to lessen the collision force (floating ice force) against the hull of the floating ice flowing in the direction of an arrow A towards the front of the bow.

In FIG. 2, the deck 10 formed on the upper surface of the movable hull part 8 is a working deck for carrying out submarine excavation such as oil excavation. On the deck 10, various equipments and apparatus are installed which are required for operation, such as a derrick 14 for installing an excavator (not shown). From the excavator, an excavating drill pipe 15 is extended toward the sea bottom through the vertical through-hole 5 of the moorage hull part 3. Excavation is conducted by means of a drill provided on the end of the pipe 15.

Figure 4:
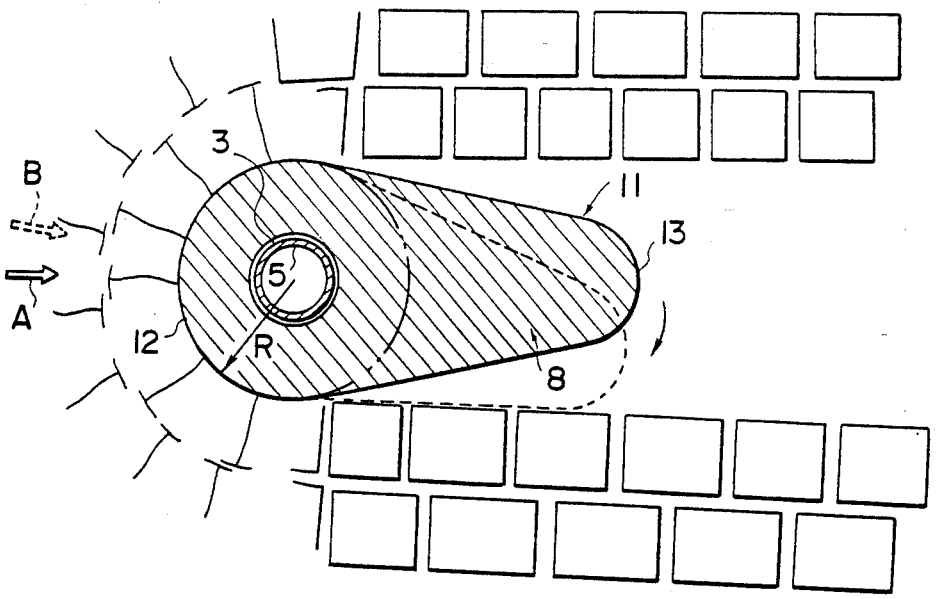
FIG. 4 is a sectional view of the floating offshore structure shown in FIG. 1 taken along a water plane thereof, particularly illustrating the state of floating ice around the same.

According to the embodiment described above, in an excavating operation by means of the floating offshore structure moored in a frozen sea, when floating ice (thickness: 1 m, for example) flows in the direction of the arrow A as shown in FIG. 4, although the floating ice force applied to the floating offshore structure is almost equal to that applied to a circular structure such as that shown by a two-dot chain line in FIG. 4, it is possible to allow the deck area and the displacement to be larger correspondingly to the portion projecting toward the stern. In other words, the floating ice force can be reduced for a given effective deck area or displacement, so that it is possible to obtain an efficient floating offshore structure.

In addition, since the water plane has the fore draft part 12 formed into a circular arc with a prescribed radius and the after draft part with a smaller width and projected, when the flowing direction of the floating ice changes and it flows in the direction of an arrow B, the movable hull part 8 can smoothly rotate about the moorage hull part 3, as shown in FIG. 4. In other words, since there is no need for breaking ice when the flowing direction of the floating ice changes, the movable hull part 8 can change the direction to the direction of the arrow B or even to a greater angle in accordance with the flowing direction of the floating ice, without receiving a substantial resistance. It is to be noted that when the movable hull part 8 changes the direction, a side thruster 16 can be used, if necessary. As illustrated, the side thruster 16 is generally constituted by a propeller mounted at an underwater part near the stern of the movable hull part 8.

Moreover, it is possible to reduce the value of resistance offered by floating ice, since the outer wall of the movable hull part 8 is inclined downwardly inward at least in the region near the fore draft part. The larger the inclination angle $\theta$, the smaller the resistance value. However, the inclination angle $\theta$ practically should be within a range from 15 to 70 degrees.

It is to be noted that although the fore draft part 12 has a circular shape in the above description, practically, there are cases where the shape of the fore draft part 12 is a polygon with a large number of vertexes. It is to be understood that the circular fore draft part according to the invention includes the above-mentioned polygon as long as there is no hindrance to the working of the invention in view of the objects or action and effect thereof, although it depends on the number of the vertexes, the roundness of each vertex or the hardness of ice, to say more precisely.

FIGS. 5 thru 10 show other various preferred embodiments of the invention. In the Figures, the parts corresponding to those of the first embodiment described with reference to FIGS. 1 thru 4 are denoted by the same reference numerals.

Figure 5:
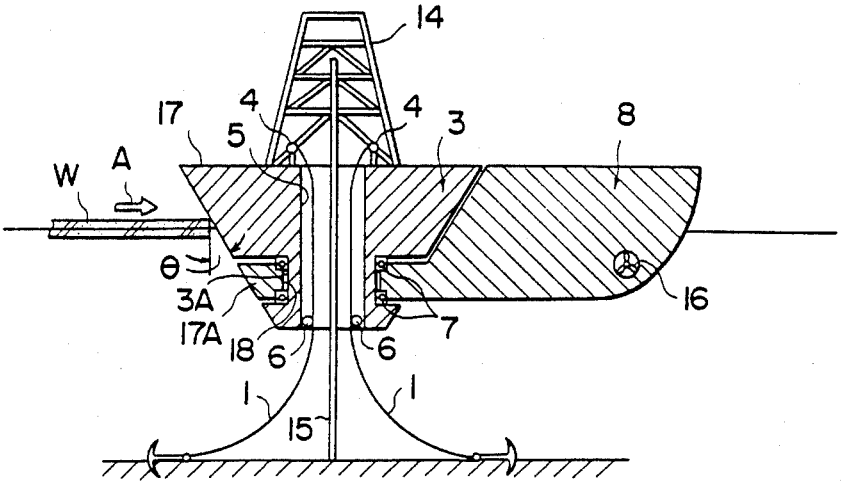
FIG. 5 is a sectional side elevational view of a floating offshore structure in accordance with a second preferred embodiment of the invention.
Figure 6:
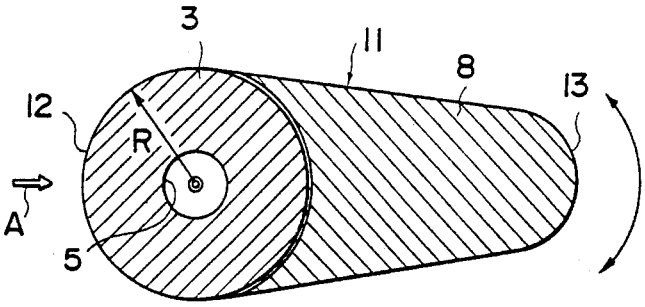
FIG. 6 is a sectional view of the floating offshore structure shown in FIG. 5 taken along a water plane thereof.

FIGS. 5 and 6 in combination show a second preferred embodiment of the invention.

In this embodiment, a hull defining the outer wall of a floating offshore structure is composed of both the moorage hull part 3 and the movable hull part 8.

The moorage hull part 3 having the vertical through-hole 5 for receiving the excavating drill pipe 15 and the mooring hawsers 1 has a shape of a rotatable body (a substantially truncated cone, according to the illustrated embodiment) with the through-hole axis as a center. The upper surface of the moorage hull part 3 serves as a fore stationary deck 17. The winches 4 for the mooring hawsers 1 and the derrick 14 for the excavator are installed on the stationary deck 17.

The movable hull part 8 is connected to the moorage hull part 3 so as to be rotatable about the center of the through-hole 5. In this embodiment, a hole 18 is formed in a hull bottom extended part 17A projecting toward the bow at an underwater position of the movable hull part 8, and the moorage hull part 3 is inserted in the hole 18 through the bearings 7 to assemble the floating offshore structure. In greater detail, the moorage hull part 3 has at an underwater part thereof a neck part 3A with an outer peripheral wall vertically extended, and this neck part 3A is fitted in the hole 18.

As shown in FIG. 6, a horizontal section of the hull near the water surface W has a substantially oval shape including the circular fore draft part 12 defined by the moorage hull part 3 and the narrower-width after draft part 13 defined by the movable hull part 8 and taperingly projecting from the fore draft part 12.

Moreover, the moorage hull part 3 has substantially a truncated cone shape, which upwardly enlarges, and the fore outer wall thereof is inclined downwardly inward (angle: $\theta$).

As described above, the floating offshore structure shown in FIGS. 5 and 6 differs from that shown in FIGS. 1 thru 4 in that the hull is composed of both the moorage hull part 3 and the movable hull part 8, but the two structures are practically the same in other respects.

Accordingly, this embodiment also permits the floating ice force to be reduced for a given effective deck area or displacement similarly to the case described above, when the floating offshore structure is moored in blocks of floating ice. Moreover, it is possible to attain such an advantage that the movable hull part 8 can smoothly change the direction without any need for breaking ice when the floating ice changes its flowing direction.

It is to be noted that since in this embodiment the deck fore half on the moorage hull part 3 and the deck after half on the movable hull part 8 rotate in the opposite directions to each other when the direction changes, it is necessary to dispose the various equipment and apparatus on the deck in consideration of this point.

Figure 7:
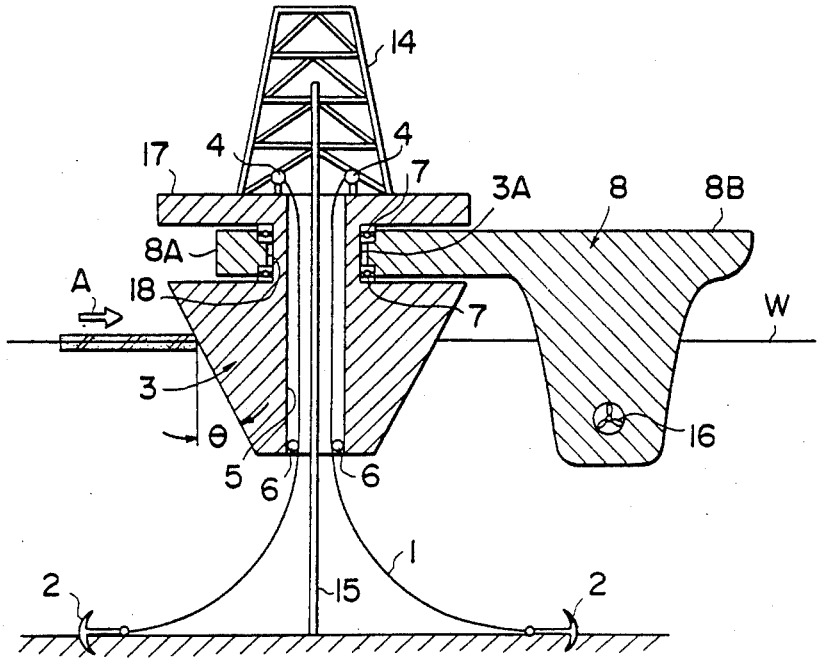
FIG. 7 is a sectional side elevational view of a floating offshore structure in accordance with a third preferred embodiment of the invention.
Figure 8:
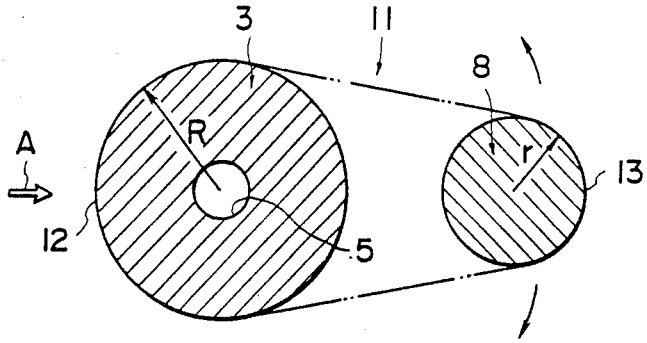
FIG. 8 is a sectional view of the floating offshore structure shown in FIG. 7 taken along a water plane thereof.

FIGS. 7 and 8 show a third preferred embodiment of the invention.

This embodiment differs from that shown in FIGS. 5 and 6 in that the movable hull part 8 is rotatably connected to the rotatable body shaped moorage hull part 3 above the water surface and that the draft part of the movable hull part 8 has a substantially circular section, but the two embodiments are practically the same in other respects.

In more detail, the neck part 3A is formed in the upper part of the substantially truncated cone shaped moorage hull part 3, i.e., above the water surface W, and the extended part 8A of the movable hull part 8 is rotatably fitted with the neck part 3A through the bearings 7. The movable hull part 8 is formed into substantially an inverted truncated cone shape having a smaller diameter than the moorage hull part 3, and the extended part 8A is horizontally extended from an upper end surface 8B thereof. Therefore, a horizontal section 11 near the water plane has a shape with two separate parts, i.e., the moorage hull part 3, as the fore part, having a radius R and the movable hull part 8, as the after part, having a radius r, as shown in FIG. 8.

This embodiment also offers the same advantage as the embodiment shown in FIGS. 1 thru 4 or that shown in FIGS. 5 and 6.

Figure 9:
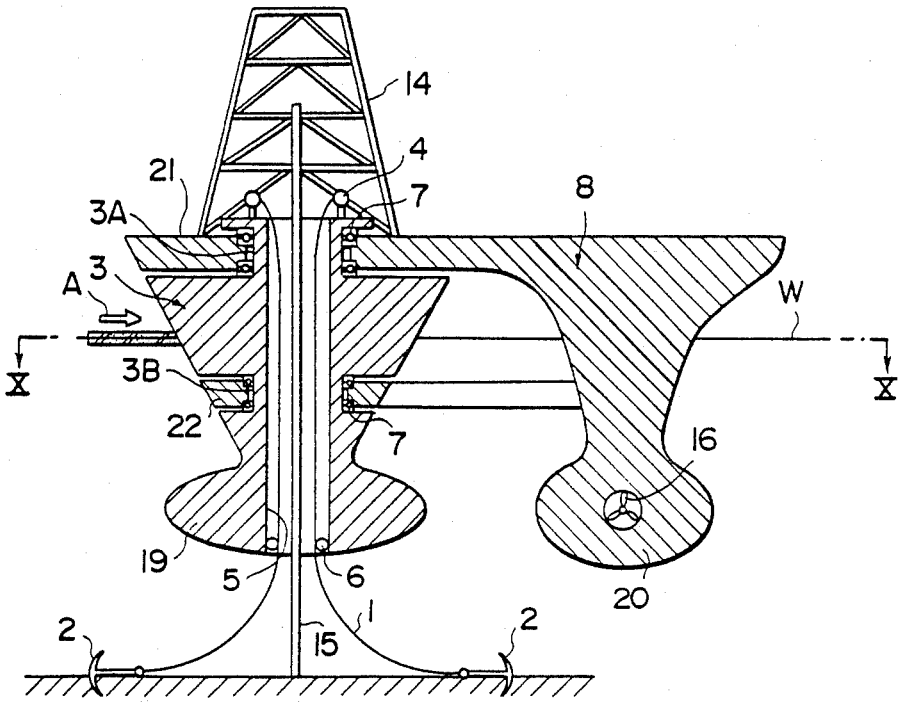
FIG. 9 is a sectional side elevational view of a floating offshore structure in accordance with a fourth preferred embodiment of the invention.
Figure 10:
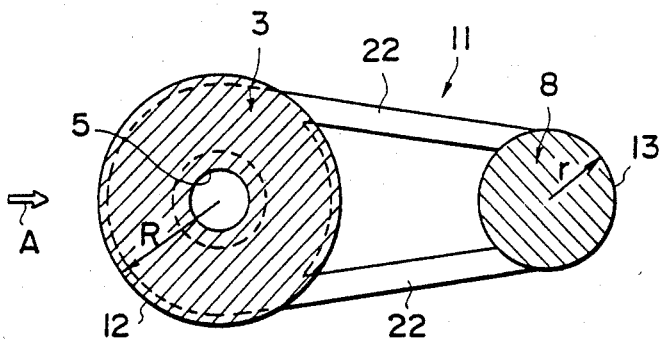
FIG. 10 is a sectional view of the floating offshore structure shown in FIG. 9 taken along a line X—X, i.e., a water plane thereof.

FIGS. 9 and 10 show a fourth preferred embodiment of the invention.

This embodiment differs from the embodiment shown in FIGS. 7 and 8 in that the movable hull part 8 is connected to the moorage hull part 3 at two positions, above and below the water surface, that the deck is defined by the upper surface of the movable hull part 8, and that expanded parts 19 and 20 for suppressing heaving and dipping are formed at the bottom parts of the moorage hull part 3 and the movable hull part 8, respectively, but the two embodiments are practically the same in other respects.

More specifically, the moorage hull part 3 has a first neck part 3A and a second neck part 3B formed at the upper end part thereof and a position thereof below the water surface respectively. A first extended part formed by horizontally extending the deck part of the movable hull part 8 is rotatably fitted with the first neck part 3A, while a second extended part 22 forming a yoke shape by horizontally extending from an underwater position of the movable hull part 8 is rotatably fitted with the second neck part 3B. In this embodiment, the first extended part 21 is defined as the deck of the floating offshore structure.

According to this embodiment, besides the above-mentioned advantages, it becomes relatively easier to design, in consideration of strength, the connection structure of the movable hull part 8, i.e., the first and second extended parts 21 and 22. Accordingly, such an effect can be attained that it is possible to effectively suppress oscillations in the directions of 6 degrees of freedom, such as heaving, pitching and rolling of the hull in a stormy weather.

Figure 11:
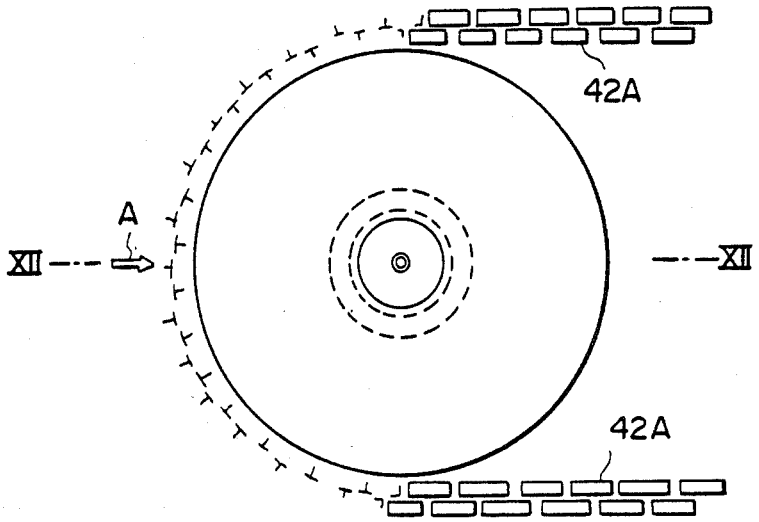
FIG. 11 is a plan view of a floating offshore structure in accordance with a fifth preferred embodiment of the invention.
Figure 12:
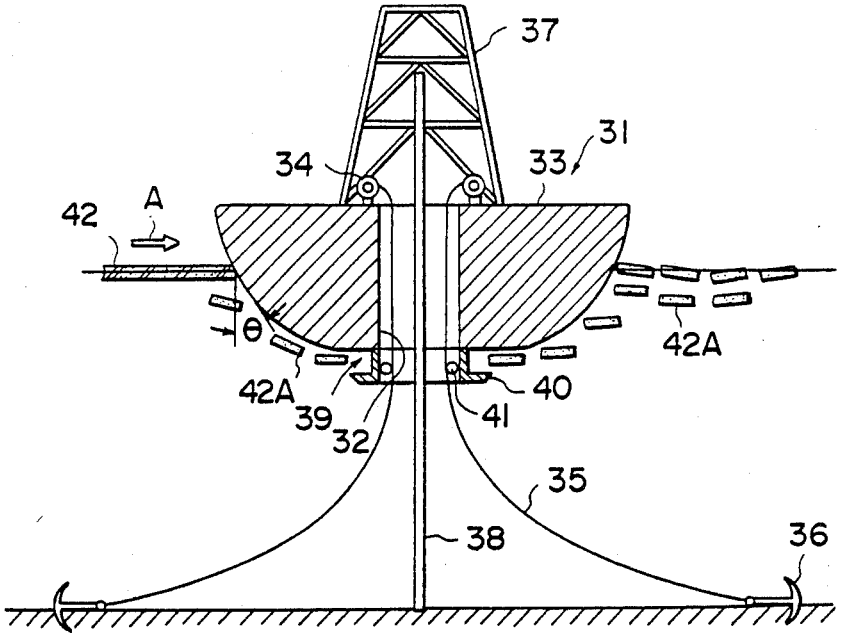
FIG. 12 is a sectional view taken along a line XII—XII of FIG. 11.

FIGS. 11 and 12 show a fifth preferred embodiment of the invention.

According to this embodiment, a hull 31 of a floating offshore structure, i.e., the main body, is formed in one body and has a vertical through-hole 32 formed in a substantially central part thereof. The floating offshore structure is moored at a fixed position on the sea by means of a plurality of mooring hawsers 35 extending through the through-hole in the sea from a plurality (e.g., twelve) of winches 34 installed on a deck 33 around the through-hole and anchors 36 connected to the ends of the mooring hawsers 35 respectively.

A derrick 37 for installing an excavator (not shown) is secured onto the deck 33. An excavating drill pipe 38 driven by the excavator is passed through the vertical through-hole 32 and extended to the sea bottom.

A tubular body 39 downwardly projecting from the hull bottom is disposed around the opening of the vertical through-hole 32 opened in the hull bottom. An overhanging part 40 is formed on the outer periphery of the lower end of the tubular body 39.

In addition, pulleys 41 for guiding the respective mooring hawsers 35 are disposed on the inner surface of the tubular body 39 in order to prevent the mooring hawsers 35 from contacting the wall of the through-hole 32 or the tubular body 39.

Moreover, the outer wall of the hull 31 is inclined downwardly inward by an angle $\theta$ at least at a part near the water surface W (water plane).

In case of employing the above-described floating offshore structure in a frozen sea, when floating ice 42 floating near the water surface W and flowing in the direction of an arrow A collides against the hull outer wall, the floating ice breaks into a large number of ice blocks 42A, as illustrated. Although the floating ice force applied to the hull 31 is reduced correspondingly to the inclination angle $\theta$ of the outer wall, some of the broken ice blocks 42A scatter underwater and flow near the hull bottom.

However, since the tubular body 39 is provided in this embodiment, it is possible to prevent the ice blocks 42A from entering the vertical through-hole 32 or directly colliding with the excavating drill pipe 38 and the mooring hawsers 35, thereby allowing the excavating drill pipe 38 and the mooring hawsers 35 to be protected from damage.

Moreover, since the overhanging part 40 is formed on the outer periphery of the lower end of the tubular body 39, also such an effect can be obtained that it is possible to suppress oscillations of the floating offshore structure, i.e., oscillations in the direction of 6 degrees of freedom, such as heaving, pitching and rolling.

Figure 13:
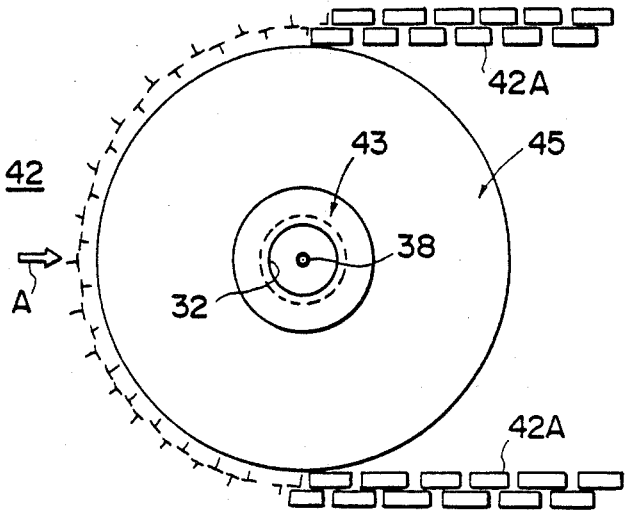
FIG. 13 is a plan view of a floating offshore structure in accordance with a sixth preferred embodiment of the invention.
Figure 14:
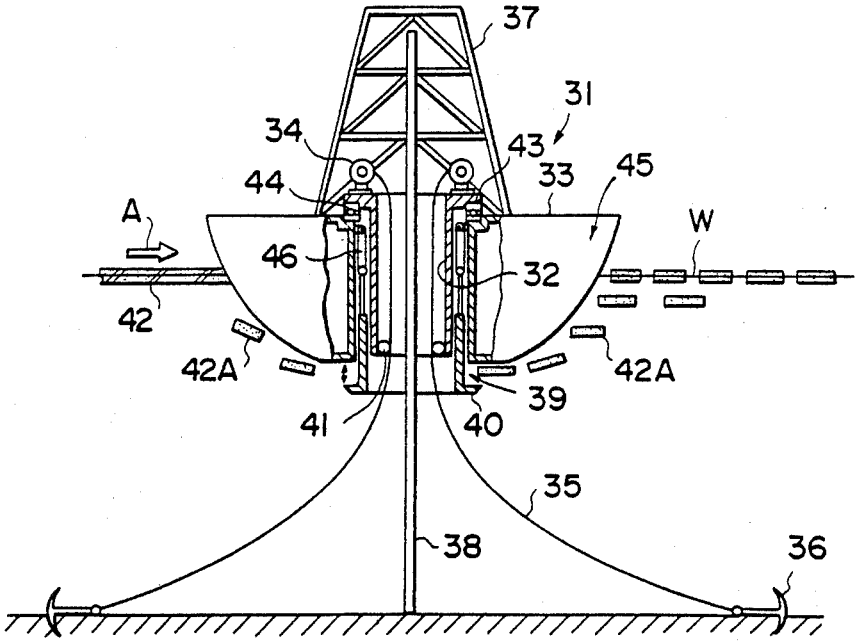
FIG. 14 is a partially cutaway side elevational view of the floating offshore structure shown in FIG. 13.

FIGS. 13 and 14 show a sixth preferred embodiment of the invention.

This embodiment differs from the above-described embodiment in that the hull 31 is constituted by a moorage hull part 43 which is moored at a fixed position on the sea by means of the mooring hawsers 35 and the anchors 36 connected to the ends thereof respectively and a movable hull part 45 rotatably fitted with the moorage hull part 43 through bearings 44 and that the tubular body 39 provided around the opening of the vertical through-hole 32 formed in the hull bottom can be adjusted to the illustrated projecting position and a withdrawn position inside the hull 31 by means of cylinders 46 driven by means of oil pressure or the like. The two embodiments are, however, practically the same in other respects. Accordingly, like or corresponding parts are denoted by like reference numerals respectively, and a detailed description thereof is omitted.

According to this embodiment, in case of employing the floating offshore structure in a frozen sea, it is possible to obtain the same advantages as the above-described embodiment. Moreover, since the hull 31 is constituted by both the moorage hull part 43 and the movable hull part 45, it is possible to obtain an effect that the movable hull part 45 can change the direction in accordance with the direction of the floating ice force applied thereto and the force can be lessened correspondingly. In addition, such an effect can be obtained that it is possible to reduce resistance in towing, since the tubular body 39 can be adjusted to the withdrawing position.

As will be apparent from the above description, according to the fifth and sixth embodiments, it is possible to obtain a floating offshore structure capable of protecting the excavating drill pipe and mooring hawsers disposed through the vertical through-hole from floating ice by preventing floating ice from entering the through-hole, as well as suppressing the heaving and dipping of the hull.

Figure 15:
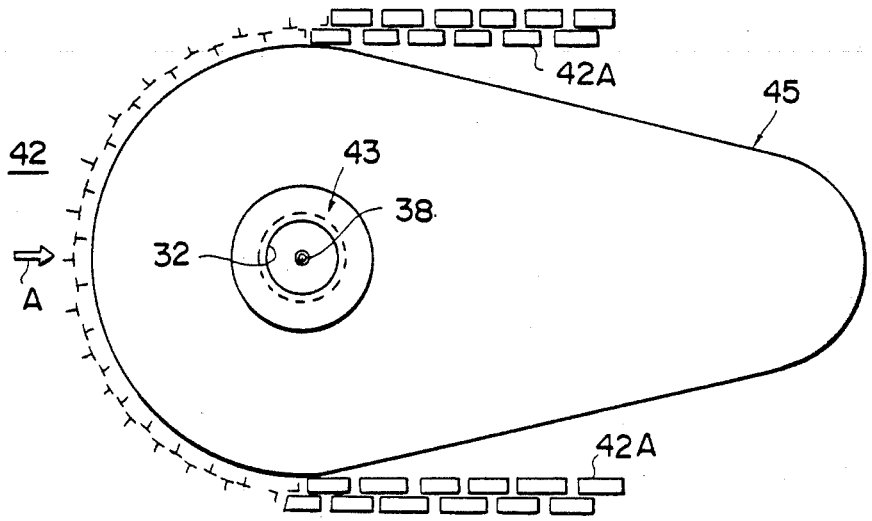
FIG. 15 is a plan view of a floating offshore structure in accordance with a seventh preferred embodiment of the invention.
Figure 16:
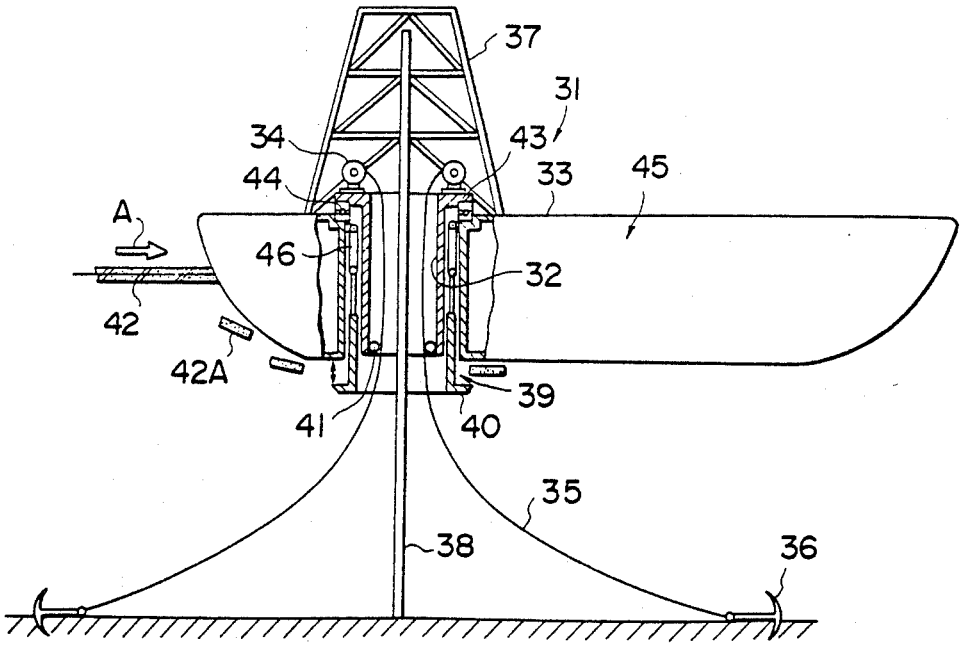
FIG. 16 is a partially cutaway side elevational view of the floating offshore structure shown in FIG. 15.

Finally, a seventh preferred embodiment of the invention is shown in FIGS. 15 and 16. This embodiment is constituted by combining the embodiment shown in FIGS. 1 and 2 and that shown in FIGS. 13 and 14. Parts identical or corresponding to those shown in FIGS. 13 and 14 are denoted by the same reference numerals as those in FIGS. 13 and 14, and a detailed description thereof is omitted. In other words, this embodiment differs from the above-described sixth embodiment in that the movable hull part 45 has a substantially oval planar shape at the deck 33 and its water plane similar to the first embodiment so that the movable hull part 45 can smoothly rotate in response to the change in the flowing direction of floating ice or the like and moreover the deck area can be increased without receiving a larger floating ice force. The sixth and seventh embodiments are, however, practically the same in other respects. Therefore, according to this embodiment, it is possible to obtain the effect offered by the first embodiment, together with that presented by the sixth embodiment.

Although the invention has been described through specific terms, it is to be noted here that the described embodiments are not exclusive and various changes and modifications may be imparted thereto without departing from the scope of the invention which is limited solely by the appended claims.

We claim:

1. A floating offshore structure for mooring at a fixed position on the sea by means of a mooring hawser having an anchor connected at the end thereof, for conducting a submarine excavating operation by an excavating drill pipe, comprising:

a hull;

a vertical through-hole formed in said hull;

means for preventing floating objects such as broken ice from entering said vertical through-hole, comprising a tubular body projecting downwardly from a bottom of said hull substantially coaxial with said vertical through-hole such that the mooring hawser and the excavating drill pipe can be extended through said vertical through-hole and tubular body to the sea bottom, said tubular body in an operative position projecting below said hull bottom a sufficient distance to prevent said floating objects from entering said vertical through hole, but without reaching said sea bottom; and means for suppressing oscillation of said floating offshore structure, comprising an overhanging member projecting radially outwardly from an outer periphery of a lower end of said tubular body.

2. A floating offshore structure accoridng to claim 1, wherein said tubular body can be withdrawn from its projecting operative position to a withdrawn position substantially within said hull.

3. A floating offshore structure according to claim 1, wherein said hull has a mooring hull part for mooring at a fixed position on the sea by means of a mooring hawser having an anchor connected to an end thereof, and a movable hull part rotatably fitted about said moorage hull part, said vertical through-hole being formed in a central part of said moorage hull part.

4. A floating offshore structure according to claim 3, wherein said movable hull part has a substantially oval horizontal cross-section near its water plane.

* * * * *